US005848545A

United States Patent [19]

Michisaka

[11] Patent Number: 5,848,545

[45] Date of Patent: Dec. 15, 1998

[54] EXTRUDED MATERIAL FOR EXPANSION WORKING AND METHOD OF EXPANSION WORKING

[75] Inventor: Hirozo Michisaka, Izumishi, Japan

[73] Assignee: Showa Aluminum Corporation, Osaka, Japan

[21] Appl. No.: 813,280

[22] Filed: Mar. 10, 1997

[30] Foreign Application Priority Data

Mar. 14, 1996 [JP] Japan ..... 8-057636

[51] Int. Cl.[6] ..... B21C 23/00

[52] U.S. Cl. ..... 72/256; 72/253.1

[58] Field of Search ..... 72/253.1, 256, 72/260

[56] References Cited

U.S. PATENT DOCUMENTS

| | | | |
|---|---|---|---|
| 2,458,686 | 1/1949 | Davie, Jr. | 244/117 |
| 2,742,692 | 4/1956 | Braeuninger | 29/548 |
| 2,798,286 | 7/1957 | Anderson | 29/423 |
| 2,802,509 | 8/1957 | Anderson et al. | 153/54 |
| 4,187,711 | 2/1980 | Lavochkin et al. | 72/256 |
| 4,428,218 | 1/1984 | LaRocca | 72/256 |
| 4,967,473 | 11/1990 | Wessel | 72/256 |

FOREIGN PATENT DOCUMENTS

| | | | |
|---|---|---|---|
| 169 597 | 2/1905 | Germany . | |
| 55-106625 | 8/1980 | Japan | 72/256 |
| 57-7318 | 1/1982 | Japan | 72/253.1 |

OTHER PUBLICATIONS

A guide to Aluminum Extrusions, The Aluminum Assoc., Inc., May 1979.

Patent Abstracts of Japan, vol. 004, No. 154, Oct. 28, 1980 and JP 55 106625 A.

*Primary Examiner*—Joseph J. Hail, III
*Assistant Examiner*—Ed Tolan

[57] ABSTRACT

An extruded material for expansion working comprising a main body having at least a plurality of straight portions and arcuate corner portions formed between the neighboring straight portions in cross section, and an imitation forming an annular polygon by coupling portions of said main body, wherein said corner portions have a radius of curvature (R) at the center in the direction of thickness of from 5 to 40 mm, and an inner angle (θ) formed by the neighboring two straight portions is from 90° to 125°. The imitation is removed and, then, the corner portions are expansion-worked into a flat plate.

7 Claims, 5 Drawing Sheets

EXTRUDED MATERIAL FOR EXPANSION WORKING AND METHOD OF EXPANSION WORKING

FIELD OF TECHNOLOGY

The present invention relates to an extruded material for expansion working used for a variety of applications by expanding corner portions into a flat plate.

RELATED ART

When a wide and thin flat plate of a metal is to be formed by extrusion molding, it becomes necessary to use a large extrusion die that accommodates the width of the flat plate. However, the large die is expensive to produce and has a short life. Besides, extruding a wide and thin flat plate is technically difficult. Therefore, the expansion working is employed for producing a wide flat plate by using an extrusion die of a relatively small diameter. That is, a material is extruded to have arcuate corner portions in cross section, and the corner portions of the extruded material are opened and expanded into a flat plate (Japanese Patent Laid-open No. 106625/1980, Japanese Patent Publication No. 22888/1973).

However, the above-mentioned extruded material for expansion working has heretofore been treated simply as an extruded material for producing a wide material using an extrusion die of a small diameter, and consideration has not at all been given concerning the shape thereof in terms of quality of the expansion-worked article which is the final product and economy from the extrusion to the expansion working. In particular, a large extruded material is used for producing a very large expansion-worked article. In such a case, the shape of the extruded material plays a very important role from the standpoint of quality of the expansion-worked article and economy. In view of the above-mentioned points, therefore, it has been desired to provide an excellent extruded material.

Under the above-mentioned technical circumstances, therefore, the object of the present invention is to provide an extruded material for expansion working capable of producing expansion-worked articles excellent in quality and economy, and a method of expansion working.

DISCLOSURE OF THE INVENTION

In order to accomplish the above-mentioned object, the present invention deals with an extruded material for expansion working comprising:

a main body (5)(5')(25) having at least a plurality of straight portions **(1*a*)(1*b*) - - - (1*f*),(21*a*)(21*b*)(21*e*) and arcuate corner portions (2)(22*a*)(22*b*) formed between the neighboring straight portions (1*a*)(1*b*), - - -, (1*c*)(*d*), - - - , (1*e*)(1*f*),(21*a*)(21*b*),(21*b*)(21*c*) in cross section; and an imitation (3)(23) forming an annular polygon by coupling portions of said main body (5)(5')(25); wherein, said imitation (3)(23) is removed and, then, said corner portions (2)(22*a*)(22*b*) are expansion-worked into a flat plate; and wherein, said corner portions (2)(22*a*)(22*b*) have a radius of curvature (R) at the center in the direction of thickness of from 5 to 40 mm, and the inner angle (θ) formed by the neighboring two straight portions (1*a*)(1*b*), - - - , (1*c*)(1*d*), - - - (1*e*)(1*f*) ,(21*a*)(21*b*), (21*b*) (21*c*)** is from 90° to 125°.

In the extruded material for expansion working, furthermore, it is desired that the inner angle (θ) is from 108° to 120°. In the extruded material for expansion working, furthermore, it is desired that the imitation (3) couples together the straight portions **(1*a*)(1*f*) located at both ends of the main body (5)(5') to form an annular polygon in the whole cross section, or the imitation (23) couples together the protrusions (24*b*)(24*b*) protruded from either one of the straight portions (21*a*)(21*c*) of the main body (25) to form an annular polygon in part of the cross section. It is further desired that the imitation (3)(23)** has a length of from 5 to 50 mm.

The present invention deals with a method of expansion working of an extruded material for expansion working which comprises a main body (5)(5')(25) having at least a plurality of straight portions **(1*a*)(1*b*) - - - (1*f*), (21*a*)(21*b*) (21*e*) and arcuate corner portions (2)(22*a*)(22*b*) formed between the neighboring straight portions (1*a*)(1*b*), - - - , (1*c*)(1*d*), - - - , (1*e*)(1*f*), (21*a*) (21*b*), (21*b*)(21*c*) in crops section; and said imitation (3)(23) forming an annular polygon by coupling portions of said main body (5)(5')(25)**;

said corner portions **(2)(22*a*)(22*b*) having a radius of curvature (R) at the center in the direction of thickness of from 5 to 40 mm, and the inner angle (θ) formed by the neighboring two straight portions (1*a*)(1*b*), - - - , (1*c*)(1*d*), - - - , (1*e*)(1*f*), (21*a*)(21*b*), (21*b*)(21*c*)** being from 90° to 125°; comprising the steps of:

opening a corner of said annular polygon, and expansion-working said corner portions **(2)(22*a*)(22*b*)** into a flat plate.

According to the present invention, the extruded material (10)(11)(20) for expansion working may be any metal provided it can be extrusion worked and expansion worked. A particularly preferred material is aluminum or an alloy thereof.

In the extruded material (10)(11)(20) for expansion working, the main body (5)(5')(25) refers to all portions except the imitation (3)(23) that will be removed at the time of expansion working, and includes protrusions **(4)(24*a*) (24*b*) protruded from the straight portions (1*a*)(1*b*) - - - (1*f*)(21*a*)(21*b*)(21*c*) shown in FIGS. 2 and 3 in addition to the straight portions (1*a*)(1*b*) - - - (1*f*)(21*a*)(21*b*)(21*c*) and the corner portions (2)(22*a*)(22*b*). The coupling positions of the imitation (3)(23) may be any place other than the corner portions (2)(22*a*)(22*b*) that will be expansion-worked. According to the present invention, therefore, examples of the sectional shape of the extruded material for expansion working include those in which the imitation (3) couples straight portions (1*a*)(1*f*) at both ends to form an annular polygon as a whole (FIG. 1A, FIG. 2), and the one in which the imitation (23) couples the projections (24*b*)(24*b*) formed at the straight portions (21*a*)(21*c*) to form an annular polygon in part of the cross section (FIG. 3). Generally, excellent stability in the shape is obtained during the extrusion when the straight portions (1*a*)(1*f*) at both ends are coupled together to assume an annular polygon in the whole cross section as represented by the extruded material (10)(11) for expansion working shown in FIGS. 1A and 2. In the extruded material (20) for expansion working having large protrusions (24*b*) as shown in FIG. 3, however, good stability in the shape is obtained when the large protrusions (24*b*)(24*b*) are coupled together rather than when the straight portions (21*a*)(21*c*)** at both ends are coupled together. Moreover, protrusions arranged on the inside of the polygon become obstacles which make it difficult to couple the straight portions. Or, when the whole material is formed in an annular polygonal shape as a whole with large protrusions being arranged on the outer side, the stability in the shape is rather lost, and an extrusion die of a large diameter is often required. In these cases, even when straight portions at both ends are protruded beyond the annular polygon, good stability in the shape is obtained as a whole when the protrusions are coupled together in a manner that the protrusions are on the inside of the polygon, and the die having a small diameter suffices for the need.

In the extruded material (10)(11)(20) for expansion working of the present invention, the corner portions (2)(22*a*)(22*b*) need to have a radius of curvature (R) at the center in the direction of thickness of from 5 to 40 mm. When the radius of curvature (R) is smaller than 5 mm, it becomes difficult to execute the expansion working. When the radius of curvature (R) is larger than 40 mm, on the other hand, the whole width after the expansion working becomes small, which is disadvantageous from the standpoint of producing a material having a width as large as possible using an extrusion die of a small diameter. Besides, a working roll of a large width is required for the expansion working to drive up the cost of working. Preferably, the lower limit of the radius of curvature (R) is 10 mm and its upper-limit is 20 mm.

Moreover, the inner angle (θ) of the corner portions (2)(22*a*)(22*b*) formed by th e neighboring two straight portions (1*a*)(1*b*), - - - , (1*c*)(1*d*), - - - , (1*e*)(1*f*), (21*a*)(21*b*), (21*b*)(21*c*) need to be from 90° to 125°. This is because, when the inner angle (θ) is smaller than 90°, limitation is imposed on the shape of a jig used for the expansion working and, particularly, on the shape of a lower receiving jig arranged on the inside of the corner portions (2)(22*a*)(22*b*), making it difficult to execute the expansion working. In the case of the extruded material (11)(20) having protrusions (4)(24*a*)(24*b*) on the inside of the polygon as shown in FIGS. 2 and 3, in particular, the above-mentioned tendency becomes conspicuous since the protrusions (4)(24*a*)(24*b*) becomes obstacles. It often becomes difficult to decrease the inner angle (θ) being hindered by the protrusions. In the case of a thick extruded material having a thickness of more than 4 mm, the receiving jig on the inside becomes so small that the expansion working cannot be effected to a sufficient degree. Even if expanded,, the degree of working becomes so large that the quality of the surface may deteriorate. When the inner angle (θ) exceeds 125°, on the other hand, the arc length of the corner portions (2)(22*a*)(22*b*) becomes relatively long, and the number of steps of working increases, which is disadvantageous in economy. A preferred inner angle (θ) is from 108° to 120°.

The annular polygon formed by coupling the imitation (3)(23) preferably acquires any one of a square shape, a pentagonal shape or a hexagonal shape in cross section depending upon the radius of curvature (R) of the corner portions (2) and the inner angle (θ) that are set within the above-mentioned ranges.

It is desired that the length (L) between the centers of the corner portions (2)(22*a*)(22*b*) in the circumferential direction is not larger than 200 mm by taking the diameter of the die into consideration. When the extruded material has an annular polygonal shape in the whole cross section, the length of a side of the polygon corresponds to the above length (L).

The imitation (3)(23) is to stabilize the shape by forming the whole or part of the extruded material in an annular shape in cross section and to facilitate the extrusion of a thin material. The imitation (3)(23) is removed prior to effecting the expansion working. It is desired that the imitation (3)(23) has a length of from 5 to 50 mm. When the length is smaller than 5 mm, it becomes difficult to remove the imitation (3)(23). When the length is larger than 50 mm, the shape of extrusion becomes too great, which is wasteful. Particularly it is desirable that the lower limit of the length of the imitation (3)(23) is 10 mm and its upper limit is 30 mm.

The method of expansion working of the present invention uses an extruded material (10)(11)(20) of the present invention as a material to be worked, removes the imitation (3)(23) from the extruded material (10)(11)(20) for expansion working, and executes the expansion working in a state where a corner of the annular polygon is opened. Any known expansion working system may be suitably employed without any particular limitation. Referring, for example, to FIG. 5, there can be exemplified an expansion-working apparatus in which a corner portion (2) of an extruded material (10) for expansion working from which the imitation (3) is removed is passed through between a lower receiving die (42) and a holder roll (43), the holder roll (43) is rotated while conveying the extruded material (10) for expansion working, and the corner portion (2) is compressed and is formed into a flat plate.

In the extruded material (10)(11)(20) for expansion working of the present invention, the main body (5)(5')(25) is partly coupled by the imitation (3)(23) and has an annular polygonal shape in the whole or part of the cross section thereof, and maintains good stability when it is being extruded. Besides, the shape of the expansion-worked portion lies within the aforementioned ranges owing to the radius of curvature (R) of the corner portions (2)(22*a*)(22*b*) and the inner angle (θ) defined by the two straight portions (1*a*)(1*b*), - - - , (1*c*)(1*d*), - - - , (1*e*)(1*f*), (21*a*)(21*b*), (21*b*)(21*c*). Therefore, the surface quality is not deteriorated due to the working, and an expansion-worked product is obtained featuring good surface quality. Besides, an expansion-worked article having a large width is efficiently obtained by using an extrusion die of a small diameter, and the expansion working is favorably conducted offering advantage in economy.

In addition to the above-mentioned effect, the imitation (3)(23) having a length of 5 to 50 mm can be easily removed and a minimum portion needs be disposed of, offering advantage in economy.

The method of expansion working of the present invention uses, as a material to be worked, an extruded material (10)(11)(20) of the present invention, and wherein the imitation (3)(23) is removed from the extruded material (10)(11)(20) for expansion working, and the expansion working is carried out in a state where the annular polygon is partly opened.

According to the method of expansion working which uses the extruded material (10)(11)(20) for expansion working having a predetermined shape in cross section, it is allowed to efficiently produce an expansion-worked article having a large width and a good surface quality by using an extrusion die having a small diameter. Owing to this cross-sectional shape, furthermore, less limitation is imposed on the shapes and sizes of the lower receiving jig and the roll used in the expansion working, the number of working steps is decreased, and the operation is efficiently carried out offering advantage in economy.

DESCRIPTION OF THE PREFERRED EMBODIMENTS

Extruded materials for expansion working having cross-sectional shapes as described below were obtained by using a JIS A6N01S-T5 aluminum alloy, and the experiment of expansion working was conducted by using the thus obtained extruded materials for expansion working.

(Embodiment 1)

Figure 1A:
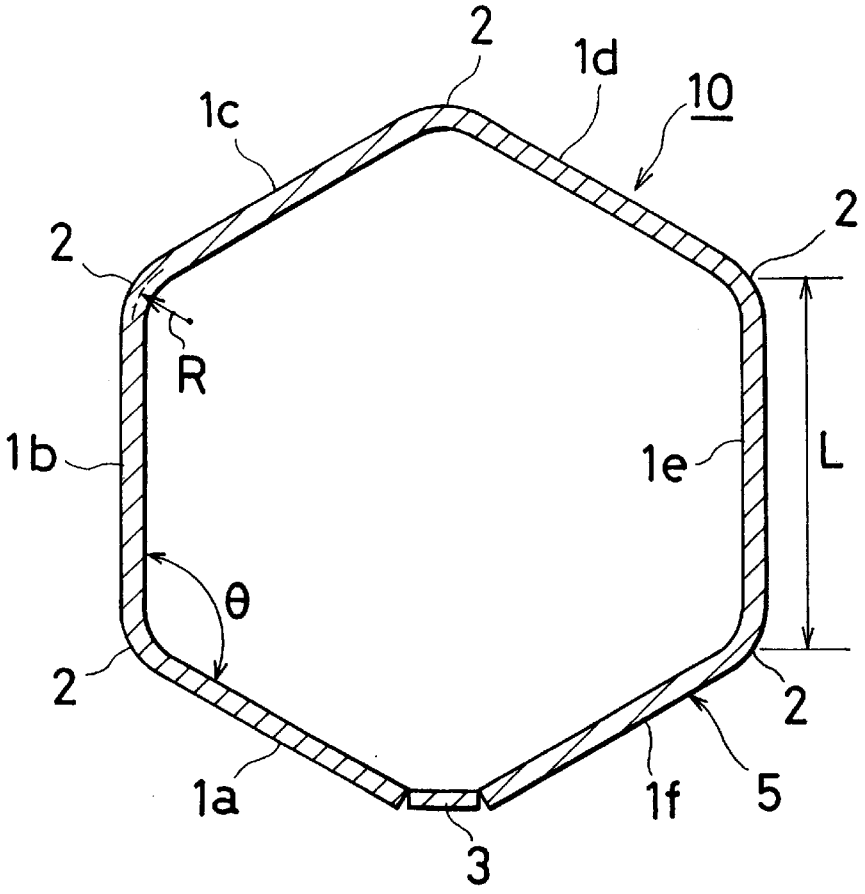
FIG. 1A is a sectional view of an extruded material for expansion working according to an embodiment 1 of the present invention.
Figure 1B:
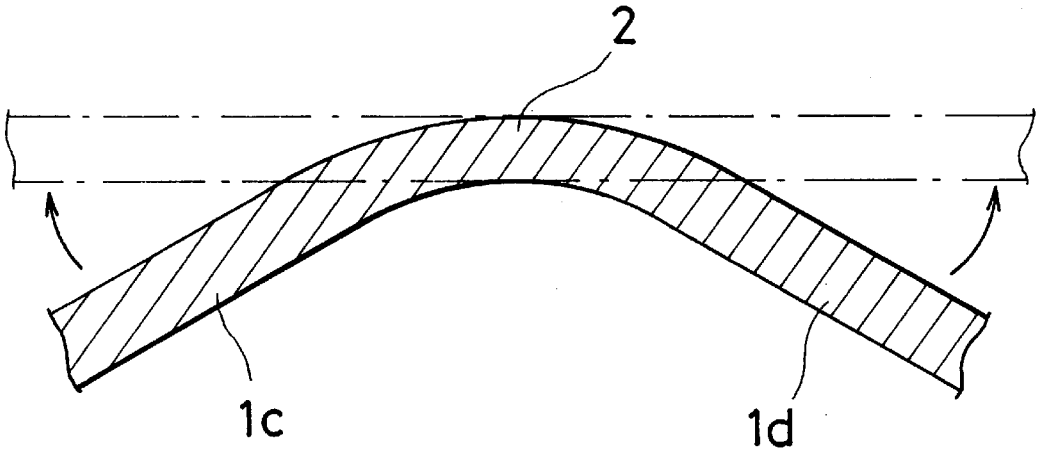
FIG. 1B is a diagram illustrating a portion of FIG. 1A on an enlarged scale and explaining expansion working.

An extruded material (10) for expansion working shown in Fig. 1A has a main body (5) constituted by six straight portions (1*a*)(1*b*) - - - (1*f*) having a thickness of 2.3 mm and five arcuate corner portions (2) formed between the neighboring straight portions (1*a*)(1*b*), - - -, (1*c*)(1*d*), - - -, (1*e*)(1*f*), the straight portions (1*a*)(1*f*) at both ends of the main body (5) being coupled together by an imitation (3) to define an annular equilateral hexagonal shape in cross section.

Each corner portion (2) has a radius of curvature of 20 mm, and an inner angle (θ) of 120° of the equilateral hexagonal shape. The imitation (3) has a length of 10 mm.

(Embodiment 2)

Figure 2:
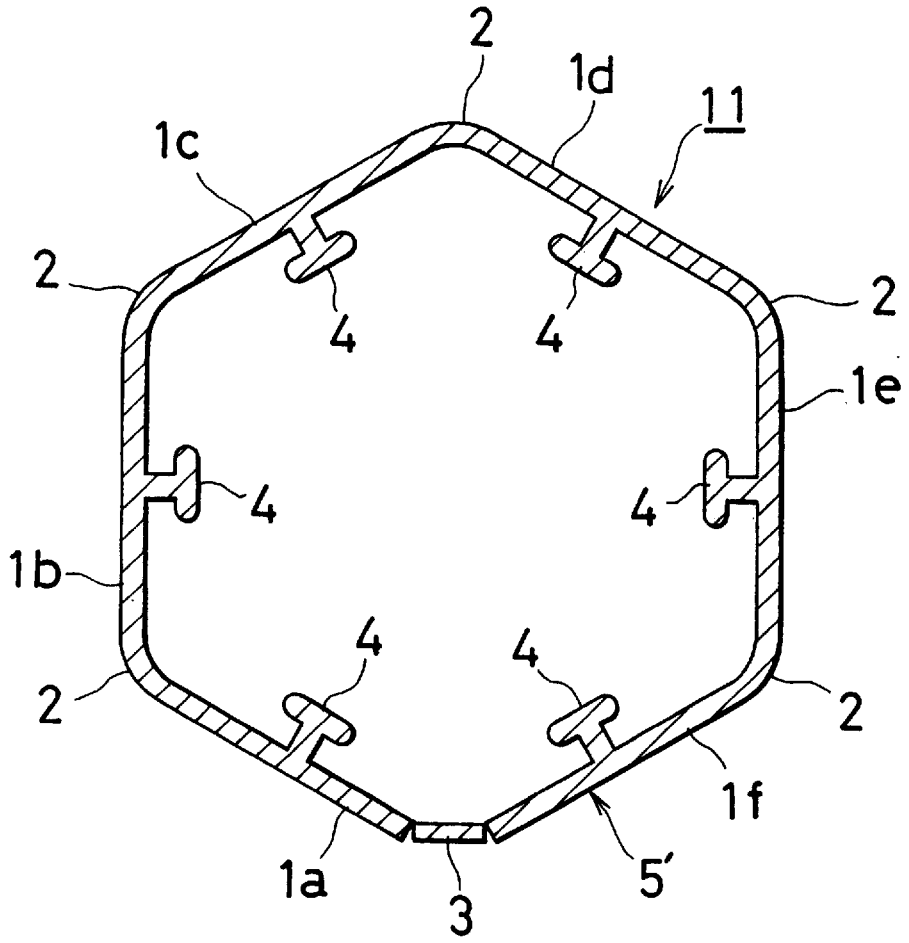
FIG. 2 is a transverse sectional view of an extruded material for expansion working according to an embodiment 2 of the present invention.

In an extruded material (11) for expansion working shown in FIG. 2, a main body (5') has straight portions (1*a*)(1*b*) - - - (1*f*) and corner portions (2) of the same shapes as those of the material (10) for expansion working of embodiment 1 in cross section, and further has a protrusion (4) on one surface of each of the straight portions (1*a*)(1*b*) - - - (1*f*). The straight portions (1*a*)(1*f*) at both ends of the main body (5') are coupled together by the imitation (3) to form an annular equilateral hexagonal shape with protrusions on the inside of the polygon.

(Embodiment 3)

Figure 3:
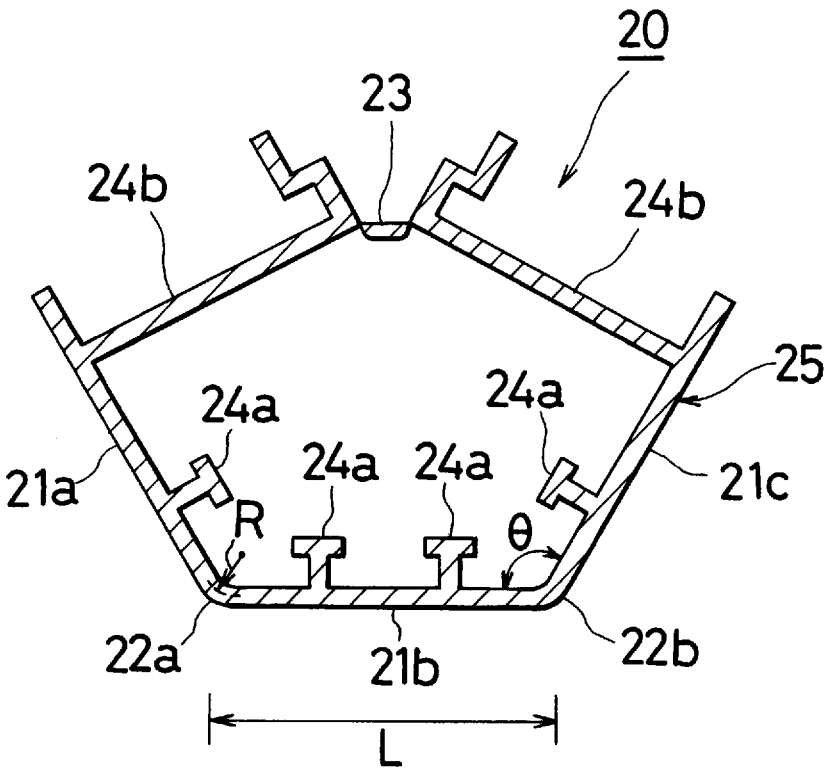
FIG. 3 is a transverse sectional view of an extruded material for expansion working according to an embodiment 3 of the present invention.

In an extruded material (20) for expansion working shown in FIG. 3, a main body (25) has three straight portions (21*a*)(21*b*)(21*c*) of a thickness of 2.3 mm and two corner portions (22*a*)(22*b*) formed between the neighboring straight portions (21*a*)(21*b*), (21*b*)(21*c*) in cross section. A second straight portion (21*b*) has two small T-shaped protrusions (24*a*). Each of a first straight portion (21*a*) and a third straight portion (21*c*) has a small T-shaped protrusion (24*a*) and a large folded protrusion (24*b*). The folded protrusions (24*b*) and (24*b*) are coupled by an imitation (23) to form an annular pentagonal shape in part of the cross section. The corner portions (22*a*)(22*b*) have an inner angle (θ) of 120° and a radius of curvature of 20 mm. The imitation (23) has a length of 25 mm.

(Comparative Example)

Figure 4:
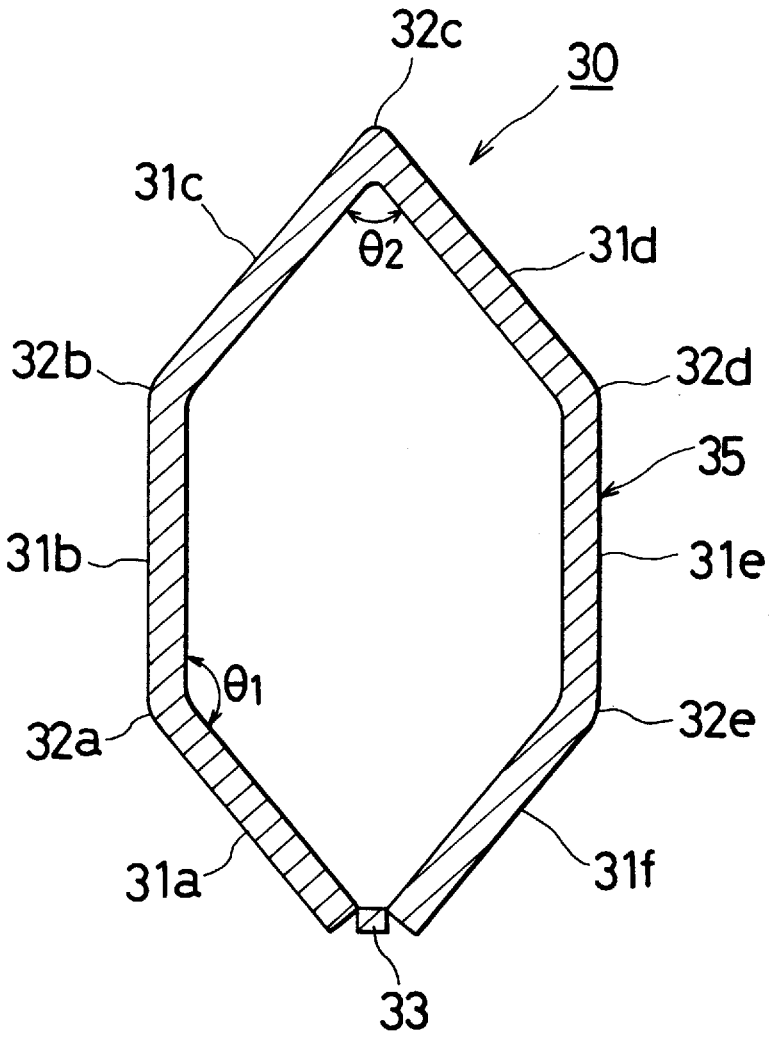
FIG. 4 is a transverse sectional view of an extruded material for expansion working of a comparative example.

In an extruded material (30) for expansion working shown in FIG. 4, like the extruded material (10) for expansion working of embodiment 1, a main body (35) has six straight portions (31*a*)(31*b*) - - - (31*f*) and five corner portions (32*a*) - - - (32*e*) between the straight portions (31*a*)(31*b*)(31*b*)(31*c*) - - - (31*e*)(31*f*), and the straight portions (31*a*)(31*f*) at both ends are coupled together by an imitation (33) to form an annular hexagonal shaped which as a whole is flattened in cross section. Therefore, the corner portions (32*a*)(32*b*)(32*d*)(32*e*) has an inner angle (θ1) of 140°, the corner portion (32*c*) has an inner angle (θ2) of 80°, which are out of the range of inner angle (θ) of 90° to 125° of the present invention. All corner portions (32*a*) - - - (32*e*) have a radius of curvature (R') of 20 mm and the imitation (3) (33) has a length of 10 mm which are the same as those of the extruded material (10) for expansion working of embodiment 1.

(Experiment of Expansion Working)

The extruded materials (10)(30) for expansion working of embodiment 1 and comparative example were subjected to the expansion working.

Prior to effecting the expansion working, the imitations (3)(33) were cut off from the extruded materials (10)(30) for expansion working, so that the polygon was partly opened. The cutting operation could be smoothly carried out for both of them.

Next, a total of three corner portions were expansion-worked, i.e., a corner portion (2) of the extruded material (10) for expansion working of embodiment 1 and two corner portions (32*a*)(32*c*) having different inner angles of the extruded material (30) for expansion working of comparative example, were expansion-worked. The corner portions (2)(32*a*)(32*c*) subjected to the expansion working possessed inner angles of 120° (θ), 140° (θ1) and 80° (θ2), and a radius of curvature of 20 mm.

Figure 5:
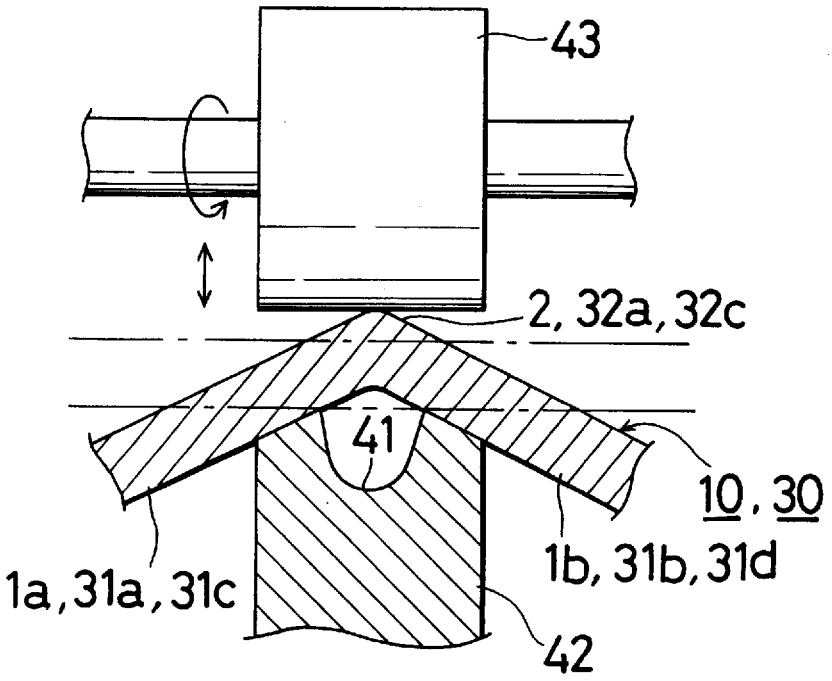
FIG. 5 is a fragmentary sectional view illustrating an example of a method of expansion working according to the present invention.

The expansion working was carried out by using an expansion-working apparatus shown in FIG. 5. According to this expansion-working apparatus, the corner portion (2) (32*a*) (32*c*) of the extruded material (10)(30) for expansion working is passed through between a holder roll (43) and a die (42) having a recessed portion (41), and the holder roll (43) is rotated while moving the extruded material (10)(30) for expansion working relative to the holder roll (43), in order to expand the corner portions (2) (32*a*)(32*c*) into a flat plate. In this experiment, the holder roll (43) possessed a width of 60 mm for every corner (2)(32*a*)(32*c*), the corner portions were passed one time each, and the extruded material (10)(30) for expansion working was fed at a constant speed.

Through the above-mentioned expansion working, the corner portion (2) of the extruded material (10) of embodiment 1, i.e., the corner portion (2) having an inner angle of 120° was worked into a highly flat plate having favorable surface quality.

On the other hand, the corner portion (32*a*) of the extruded material (30) for expansion working of comparative example having the inner angle of 140° could not be sufficiently covered for its working portion by the die (42) and the holder roll (43) of the same width since the length of the arc was relatively long though the radius of curvature was the same as that of the corner portion (2) of 120° of embodiment 1. Therefore, the material being worked was undulated at portions where it came into contact with both ends of the holder roll (43) in the direction of width. When it is attempted to obtain the same degree of flatness as that of embodiment 1, therefore, it becomes necessary to use a wide die and a wide holder roll. Moreover, the corner portion (32*c*) having an inner angle of 80° must be deformed in large amounts to become flat. In other words, the corner portion is not completely deformed by the developing working of a single pass, and arcuate shape remains. When-it is attempted to obtain the same degree of flatness as that of embodiment 1, therefore, the corner portion must be passed two or more times or an increased pressing force must be applied.

As described above, it was confirmed that the extruded material for expansion working having a cross-sectional shape as contemplated by the present invention could be expansion worked using a simple expansion-working apparatus and through a decreased number of steps compared to those which are not covered by the present invention.

It should be noted that the terms and expressions used here are only for explanatory but are not to impose any limitation or are not to exclude any matter equivalent to characteristic matters described above, but encompass a variety of modifications within a scope as claimed by the invention.

I claim:

1. An extruded material for expansion working comprising:

a main body having at least a plurality of straight portions and arcuate corner portions formed between the neighboring straight portions in cross section; and an imitation forming an annular polygon by coupling portions of said main body; wherein, said imitation is removed and, then, said corner portions are expansion-worked into a flat plate; and wherein, said corner portions have a radius of curvature (R) the center in the direction of thickness of from 5 to 40 mm, and an inner angle (θ) formed by the neighboring two straight portions is from 108° to 120°.

2. An extruded material for expansion working according to claim 1, wherein said imitation couples together the straight portions located at both ends of the main body to form an annular polygon in the whole cross section.

3. An extruded material for expansion working according to claim 1, wherein said imitation couples together the protrusions protruded from either one of the straight portions of the main body to form an annular polygon in part of the cross section.

4. An extruded material for expansion working according to claim 1, wherein said imitation has a length of from 5 to 50 mm.

5. An extruded material for expansion working according to claim 3, wherein said imitation has a length of from 5 to 50 mm.

6. An extruded material for expansion working according to claim 4, wherein said imitation has a length of from 5 to 50 mm.

7. A method of expansion working of an extruded material for expansion working which comprises a main body having at least a plurality of straight portions and arcuate corner portions formed between the neighboring straight portions in cross section; and said imitation forming an annular polygon by coupling portions of said main body;

said corner portions having a radius of curvature (R) at the center in the direction of thickness of from 5 to 40 mm, and the inner angle (θ) formed by the neighboring two straight portions is from 108° to 120°; comprising the steps of;

opening a corner of said annular polygon, and expansion-working said corner portions into a flat plate.

* * * * *

UNITED STATES PATENT AND TRADEMARK OFFICE

CERTIFICATE OF CORRECTION

PATENT NO. : 5,848,545

DATED : December 15, 1998

INVENTOR(S) : Hirozo Michisaka

It is certified that error appears in the above-indentified patent and that said Letters Patent is hereby corrected as shown below:

Claim 1, column 7, line 24, after "(R)" insert -- at --.

Signed and Sealed this

Third Day of August, 1999

*Attest:*

*Attesting Officer*

Q. TODD DICKINSON

*Acting Commissioner of Patents and Trademarks*